US006573645B1

(12) United States Patent
Bucher

(10) Patent No.: US 6,573,645 B1
(45) Date of Patent: Jun. 3, 2003

(54) DETENSIONING MASK FRAME ASSEMBLY FOR A CATHODE-RAY TUBE (CRT)

(75) Inventor: Alan Weir Bucher, Manheim, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 95 days.

(21) Appl. No.: 09/765,682

(22) Filed: Jan. 19, 2001

(51) Int. Cl.[7] ..... H01J 29/80
(52) U.S. Cl. ..... 313/405; 313/407
(58) Field of Search ..... 313/402–405, 313/407, 408

(56) References Cited

U.S. PATENT DOCUMENTS 5,218,267 A * 6/1993 Ragland, Jr. ..... 313/407
5,594,300 A * 1/1997 Nosker et al. ..... 313/402

* cited by examiner

*Primary Examiner*—William J. Royer
(74) *Attorney, Agent, or Firm*—Joseph S. Tripoli; Carlos M. Herrera; Richard LaPeruta, Jr.

(57) ABSTRACT

A detensioning mask frame assembly for a cathode-ray tube including a subframe constructed of support members that provide a support structure for mask holding blades is disclosed. The support members have different temperature coefficients of expansion, such that when heated, the support members are deflected with different thermal expansion rates causing the mask holding blades to move toward each other, and as such, relieve tension from the mask.

4 Claims, 6 Drawing Sheets

401
420
402
44
y
z
3B
3B
42
3C
3C
30
402
y
x
412
38
36
420
40
401
420

402
x
z
412
405A

DETENSIONING MASK FRAME ASSEMBLY FOR A CATHODE-RAY TUBE (CRT)

This invention generally relates to color picture tubes and, more particularly, to tension mask assemblies for cathode ray tubes capable of detensioning.

BACKGROUND OF THE INVENTION

A color cathode ray tube, or CRT, includes an electron gun for forming and directing three electron beams to a screen of the tube. The screen is located on the inner surface of a faceplate panel of the tube and is made up of an array of elements of three different color-emitting phosphors. A shadow mask, which may be either a formed mask or a tension mask, is interposed between the electron gun and the screen. The electron beams emitted from the electron gun pass through apertures in the shadow mask and strike the screen causing the phosphors to emit light so that an image is displayed on the viewing surface of the faceplate panel.

A tension mask comprises a set of strands that are tensioned onto a mask frame to reduce their propensity to vibrate at large amplitudes under external excitation. Such vibrations would cause gross electron beam misregister on the screen and would result in objectionable image anomalies to the viewer of the CRT.

The mask stress required to achieve acceptable vibration performance is below the yield point of the mask material at tube operating temperature. However, at elevated tube processing temperatures, the mask's material properties change and the elastic limit of the mask material is significantly reduced. In such a condition, the mask stress exceeds the elastic limit of the mask material and the material is inelastically stretched. When the tube is cooled after processing, the strands are longer than before processing and the mask frame is incapable of tensing the mask strands to the same level of tension as before processing. Another common problem is when the mask strand material has a lower coefficient of thermal expansion than the mask frame material. In such a case, tension on the mask strand increases during thermal processing, causing more inelastic strain.

It is, therefore, desirable to develop a mask frame assembly that allows tension masks to be uniformly detensioned during the thermal cycle used to manufacture a CRT to mitigate stretching of the mask.

SUMMARY OF THE INVENTION

The present invention relates to a detensioning mask frame assembly. The invention causes the mask frame to compress inward onto itself when heated during the CRT manufacturing process, thus relieving tension from the tension mask More specifically, the detensioning mask frame assembly of the present invention comprises a dual-compliance system where opposite edges of a tension mask are attached to two parallel mask holding blades. The holding blades are attached to the centers of two opposite sides of a subframe. The subframe is constructed of two or more materials having different coefficients of thermal expansion whereby an increase in temperature causes the subframe to deflect causing the holding blades to move toward each other. The motion of the holding blades is essentially planar (XY-plane) allowing the holding blades to move without distortion of the tension mask contour. When the holding blades move toward each other, the strain in the tension mask is relieved and the stress is reduced. Hence, at elevated temperature, the subject invention detensions the tension mask without warping the tension mask contour.

This, in turn, reduces the inelastic strain experienced by the mask during thermal processing and retains more tension in the strands after thermal processing.

BRIEF DESCRIPTION OF THE DRAWINGS

FIG. 3A shows a plan view of a mask frame assembly with the tension mask removed for clarity. FIG. 3B shows a view of the mask frame assembly along line 3B—3B including the tension mask. FIG. 3C shows a view of the mask frame assembly along line 3C—3C;

FIG. 4A shows the subframe at room temperature. FIG. 4B shows the subframe at elevated temperatures, such as that required for tube processing;

DETAILED DESCRIPTION

Figure 1:
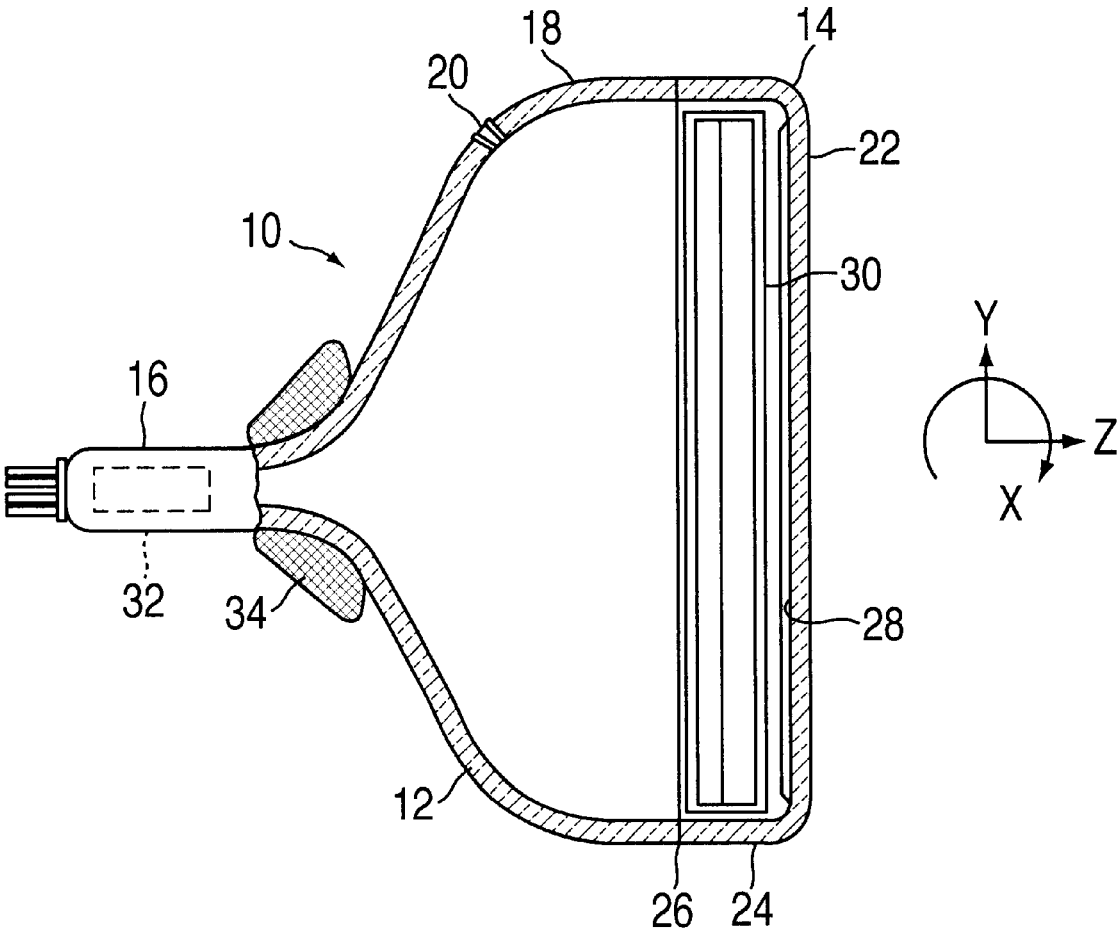
FIG. 1 is a side view, partly in the axial section, of a color picture tube, including a tension mask-frame assembly according to the present invention.

FIG. 1 shows a cathode ray tube 10 having a glass envelope 12 comprising a rectangular faceplate panel 14 and a tubular neck 16 connected by a funnel 18. The funnel 18 has an internal conductive coating (not shown) that extends from an anode button 20 to the neck 16. The panel 14 comprises a viewing surface 22 and a peripheral flange or sidewall 24 that is sealed to the funnel 18 by a glass frit 26. A three-color phosphor screen 28 is carried by the inner surface of the panel 14. The screen 28 is a line screen with the phosphor lines arranged in triads, each triad including a phosphor line of each of the three primary colors. A tension mask frame assembly 30 is removably mounted in a predetermined spaced relation to the screen 28. The mask may be either a tension mask or a tension focus mask. An electron gun 32 (schematically shown by the dashed lines in FIG. 1) is centrally mounted within the neck 16 to generate three in-line electron beams, a center beam and two side beams, along convergent paths through the tension mask frame assembly 30 to the screen 28.

The tube 10 is designed to be used with an external magnetic deflection yoke, such as the yoke 34 shown in the neighborhood of the funnel to neck junction which generates magnetic fields that cause the electron beams to scan horizontally and vertically in a rectangular raster over the screen 28.

Figures 3A, 3B, 3C:
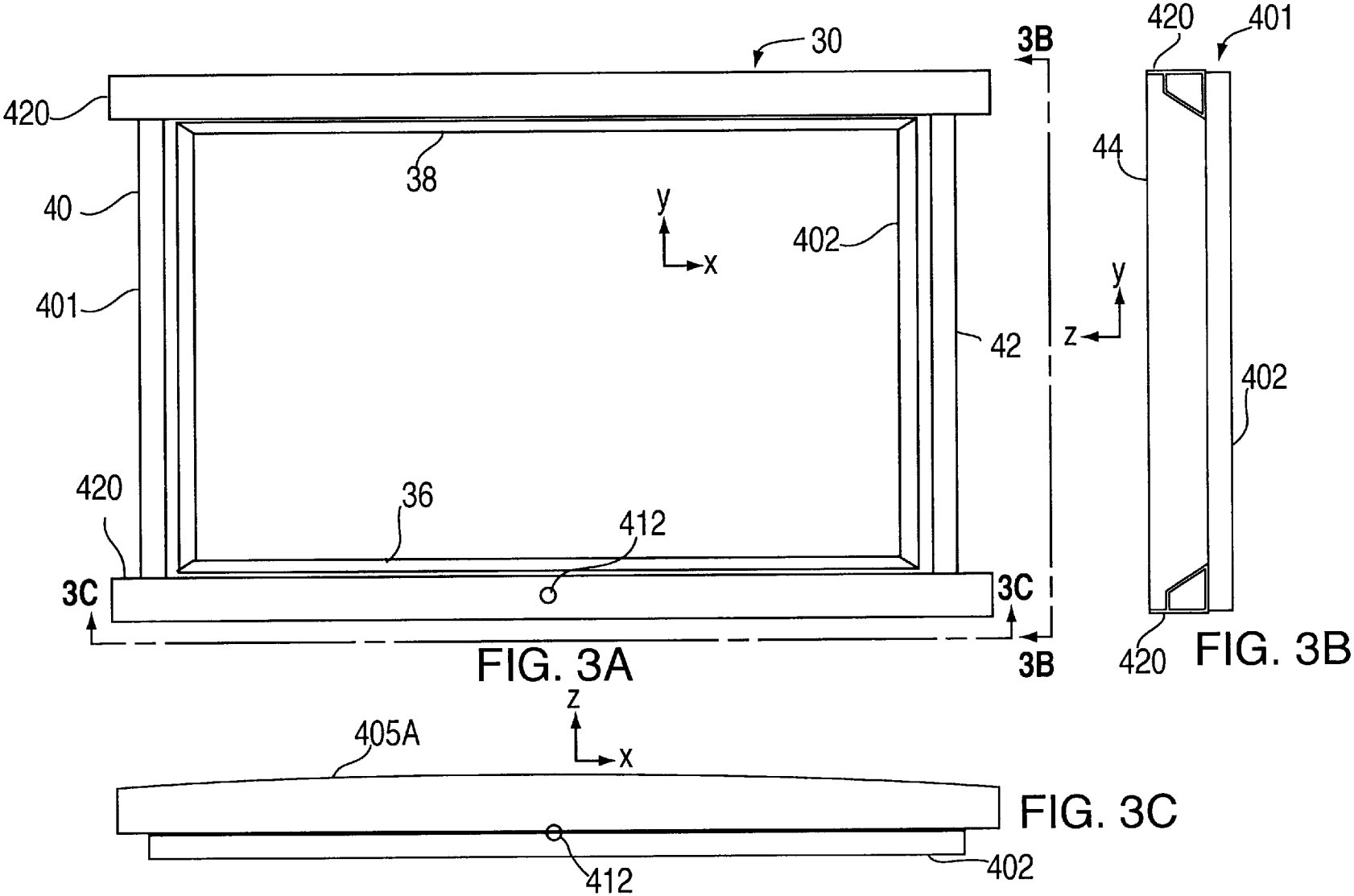
FIGS. 3A, 3B, and 3C are views of a mask frame assembly according to the present invention.

The tension mask frame assembly 30, shown in greater detail in FIGS. 3A—3C, comprises two long side supporting members 36 and 38 and two short side supporting members 40 and 42. The two long side members 36 and 38 of the tension mask frame assembly 30 parallel a central major axis, x, of the tube 10, and the two short side members 40 and 42 parallel the central minor axis, y, of the tube 10. The tension mask frame assembly 30 includes strands 44 that are parallel to the central minor axis, y,and to each other.

Figure 2A:
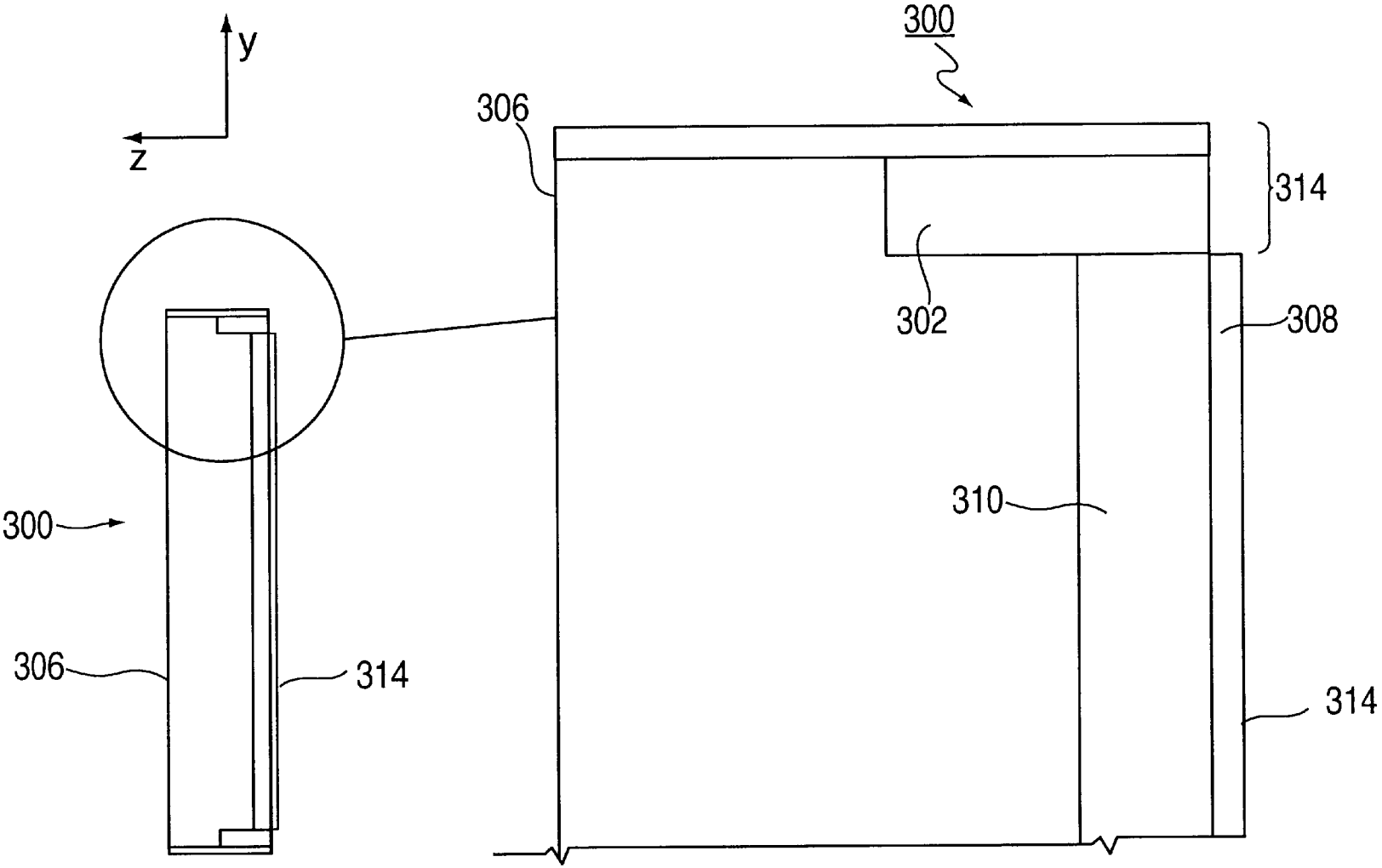
FIG. 2A PRIOR ART
FIGS. 2A and 2B are partial side views of a known tension mask frame assembly.
Figure 2B:
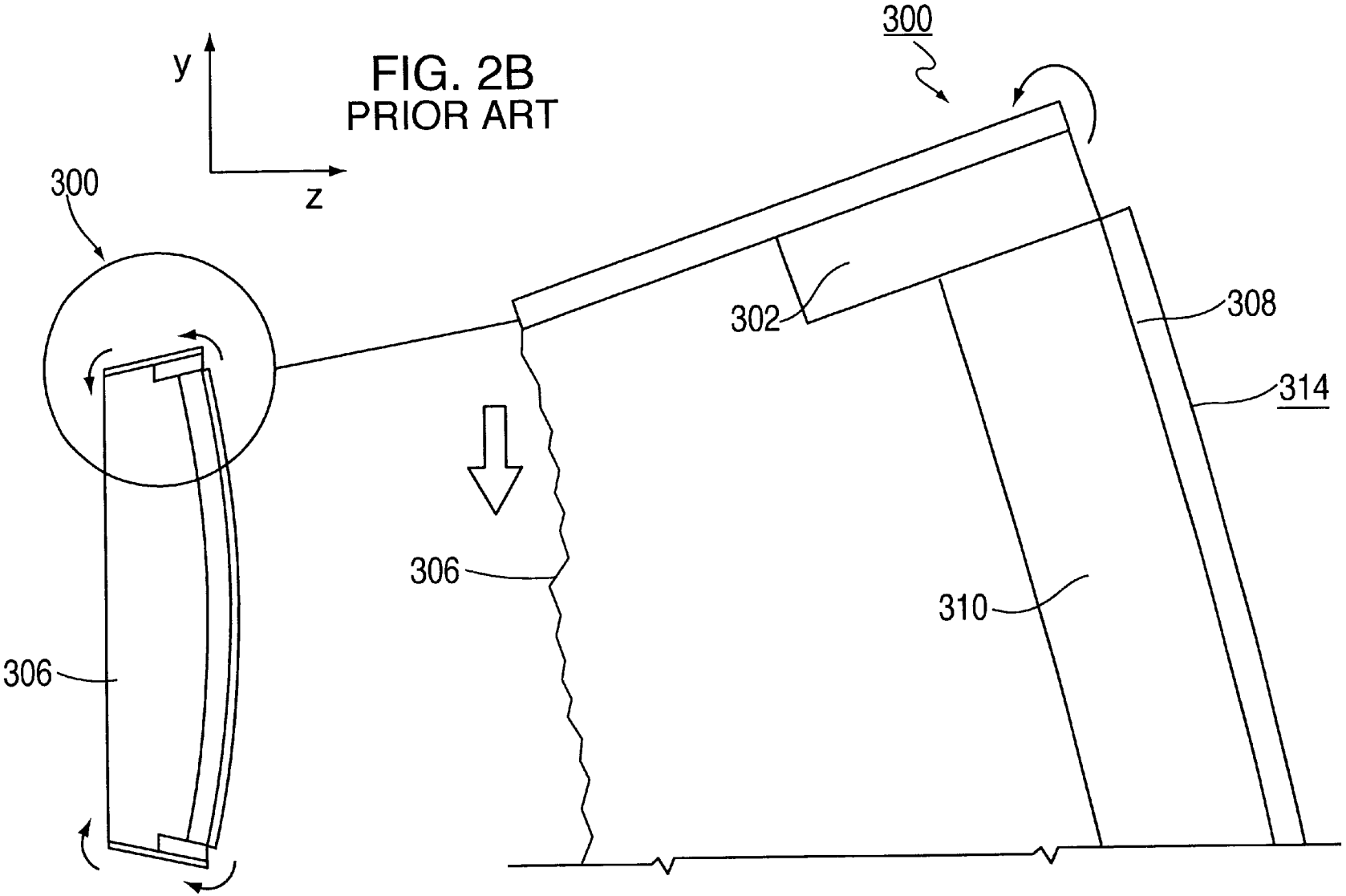
FIG. 2B PRIOR ART

FIGS. 2A and 2B depict a partial side view of a known mask frame assembly 300. The known mask frame assembly 300 consists of a frame component 314 and a tension mask 306. The frame component 314 comprises a pair of steel frame short segments 310 having a stainless steel strip 308 affixed to the rear side of the steel frame segment 310. A set of steel cantilevers 302 are attached perpendicularly to the steel frame segments 310 and the stainless steel strip 308. The stainless steel strip 308 is rigidly affixed to the steel frame segment 310, typically by seam, spot, or tack welding. The cantilevers 302 are also affixed to the stainless steel strip 308 and the steel frame segment 310 typically by seam, spot, or tack welding.

When the CRT is heated during the manufacturing process, the mask frame assembly 300 as shown in FIG. 2B expands. The stainless steel strip 308 expands more quickly than the steel frame segment 310 to which it is attached. Because the stainless steel strip 308 expands at a faster rate than the steel frame segment 310, a substantial amount of force is generated between the elements causing them to curl, with the center of curvature located toward the mask 306. This curl causes the steel cantilevers 302 to rotate inward toward the center of the mask frame assembly 300 in the Y-Z plane. As the cantilevers 302 rotate inward toward each other, the tension mask 306 loses its tension, as shown in FIG. 2B. Because the cantilevers 302 have a significant degree of flexibility, increasing toward the center of the cantilevers 302, the effect of detensioning decreases with distance from the steel frame segment 310. The tension mask 306 thus loses its tension first at the edge, then toward the center in a highly uniform manner. Such mask detensioning results in more inelastic mask strain at the center of the tension mask 306 than at its edges. Such a pattern of inelastic mask strain can result in wrinkling of the mask 306 and an inability to retain high mask tension in the center of the frame component 314 after the mask frame assembly 300 is cooled. FIG. 3A depicts a plan view of a tension mask frame assembly 30 of an embodiment of the present invention comprised of a frame assembly 401 and a tension mask (not shown for clarity). The frame assembly 401 is of the dual-compliant type and is comprised of two main subassemblies, the subframe 402 and two mask holding blades 420. FIG. 3B shows view 3B—3B of the tension mask frame assembly 30 and illustrates the spatial relationship of the strands 44 of the tension mask to the mask holding blades 420, and the mask holding blades 420 to the subframe 402. FIG. 3C shows the tension mask frame assembly 30 from view 3C—3C and depicts the curved edge 405A to which the strands 44 of the tension mask are attached.

Figure 4A:
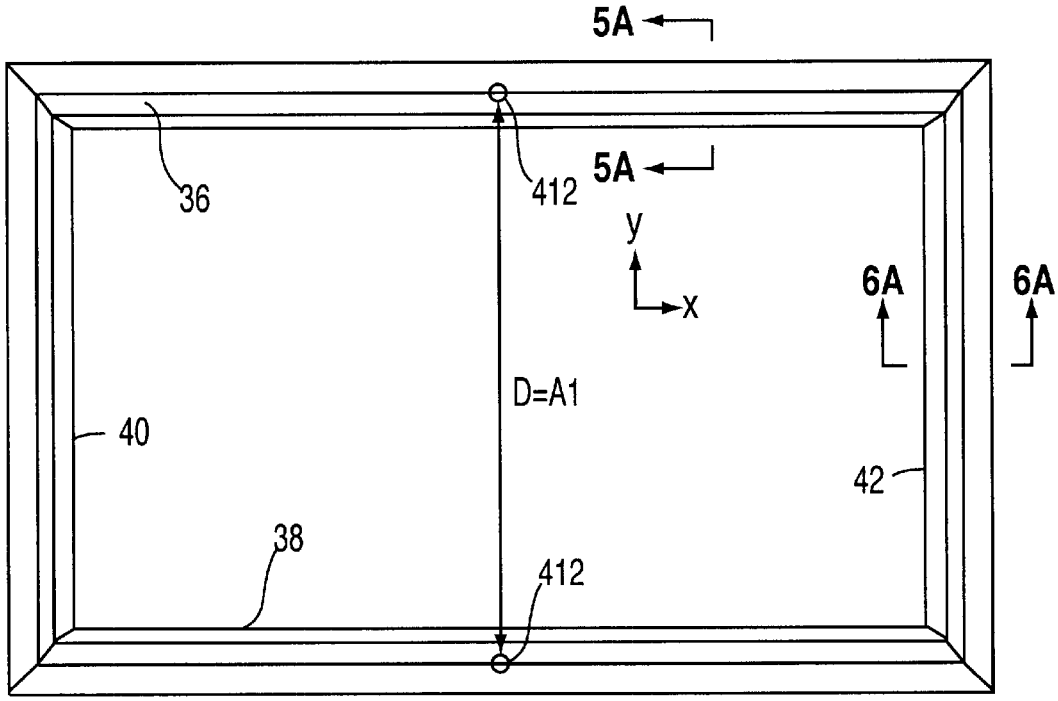
FIGS. 4A and 4B show plan views of a mask frame assembly according to the present invention with the tension mask and mask holding blades removed for clarity.

FIG. 4A shows the subframe 402 at room temperature, T1, with the mask holding blades 420 removed for clarity. The subframe 402 is constructed of two different materials having different thermal expansion coefficients. In this embodiment steel is used as the lower thermal expansion material and stainless steel is used as the higher thermal expansion material. The subframe 402 consists of two long side supporting members 36 and 38 roughly paralleling the tube's x-axis and separated by two transverse short side supporting members 40 and 42 roughly paralleling the tube's y-axis.

Operation of the present invention is best understood with reference to FIGS. 4A through 7 simultaneously. The long side supporting members 36 and 38 consist of a stainless steel (higher expansion) portion 403A and a steel (lower expansion) portion 403B, with the stainless steel portion 403A placed on the inside region of the subframe 402 shown in FIG. 5. The short side supporting members 40 and 42 consist of a stainless steel (higher expansion) portion 404A and a steel (lower expansion) portion 404B, with the stainless steel portion 404A placed on the outside region of the subframe 402 shown in FIG. 6. The distance between blade attachment points 412 are given by dimension D=A1 in FIG. 4A and dimension D=A2 in FIG. 4B.

Figure 4B:
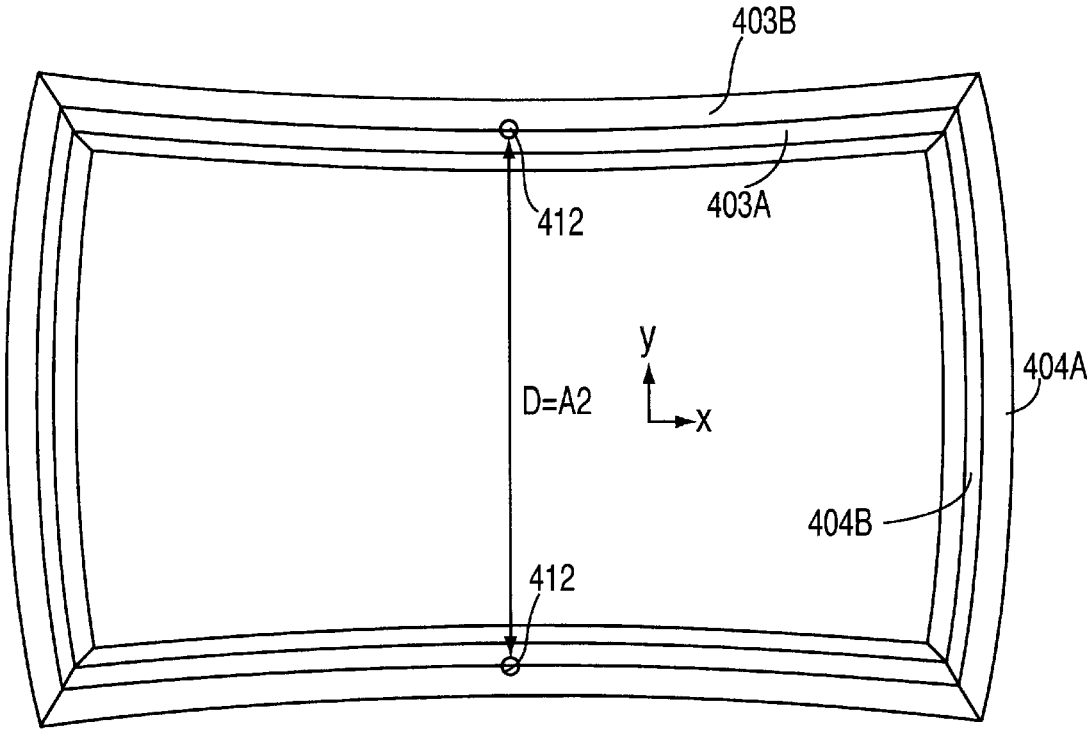
Figure 5:
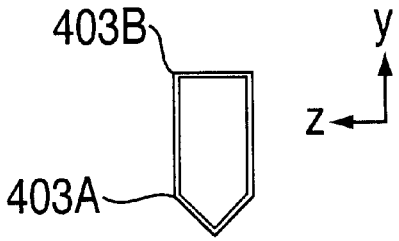
FIG. 5 shows a cross-sectional view of the subframe along line 5A—5A of FIG. 4A.
Figure 6:
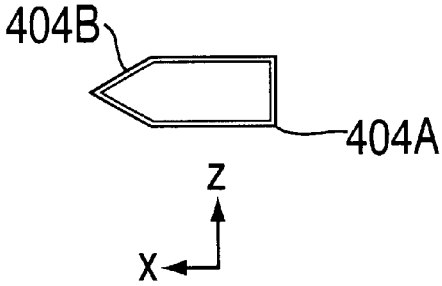
FIG. 6 shows a cross-sectional view of the subframe along line 6A—6A of FIG. 4A.

As the subframe 402 is heated, the higher coefficient of thermal expansion of the stainless steel portion causes the stainless steel portion to elongate more than the steel portion. Since the portions of the subframe 402 are joined to each other, the long side supporting members 36 and 38 and short side supporting members 40 and 42 curl in the XY plane with the center of curvature lying on the steel side of the members 36, 38, 40 and 42. Therefore, there is a net change of spacing between the attachment points 412. FIG. 4B shows the subframe 402 at elevated temperature, T2 (>T1), such as that encountered by the tube during thermal processing, resulting in a separation distance of A2 which is less than A1 which results in a closing of the spacing between the attachment points 412. Since the mask holding blades 420 are attached to points 412, the mask holding blades 420 also move toward one another, thus relaxing the tension on the mask stretched between them.

Figure 7:
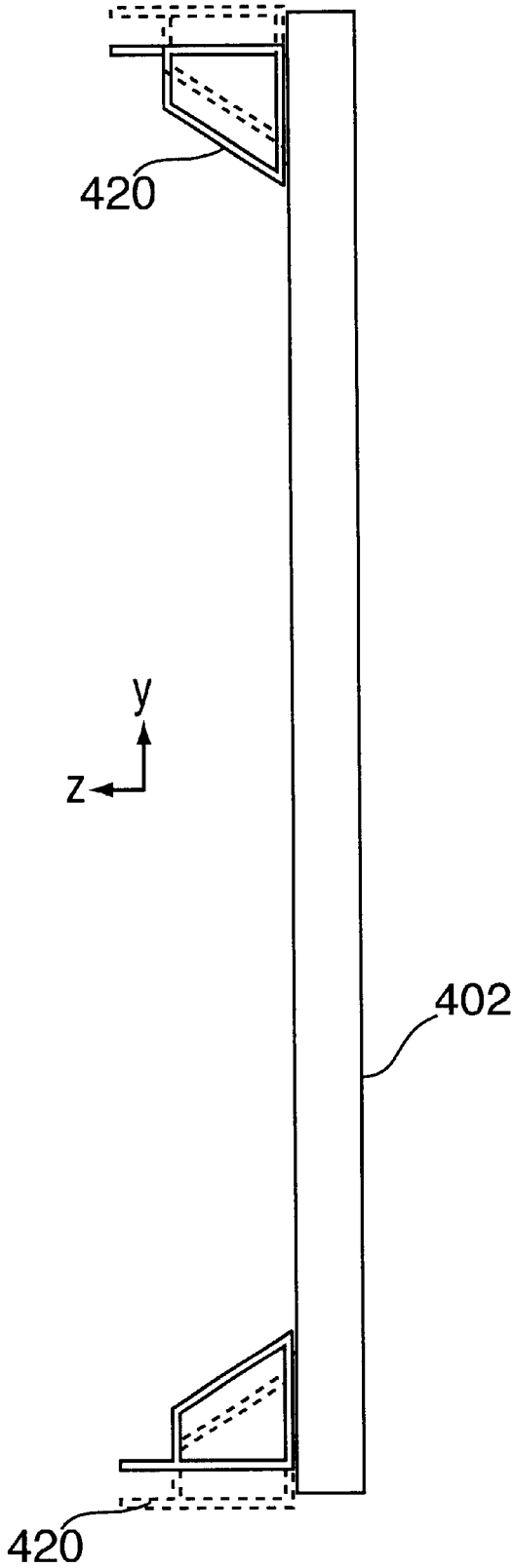
FIG. 7 shows a view along line 3B—3B in FIG. 3A illustrating the movement of the mask holding blade as the mask frame assembly of the present invention is heated.

FIG. 7 shows the mask frame assembly 30 from view 3B—3B of FIG. 3A at temperatures T1 and T2, illustrating how the mask holding blades 420 move toward one another at elevated temperatures. The dashed lines represent the mask frame assembly 30 at temperature T1, while the solid lines represent the mask frame assembly 30 at temperature T2. The motion of the mask frame assembly 30 is essentially planar, occurring in the XY-plane. This means that the mechanism for mask detensioning causes no contour change. If the mask holding blades 420 are quite stiff, this planar motion results in uniform detensioning of the tension mask. If the mask holding blades 420 are flexible, the motion causes the center of the mask to detension first. This results in the outer edges detensioning less than the center.

It should be appreciated that different sizes and different types of CRTs may require different amounts of thermal correction. Therefore, various combinations of and modifications to the foregoing embodiment may be necessary to meet these different requirements. For example, it is contemplated that separate thermal deformation members, attached to one another, may be used to form the specific portions of the subframe 402. In this case, the supporting members 36, 38, 40 and 42 defining the subframe 402 are formed of two metallic pieces having different temperature coefficients of expansion arranged in side-by-side abutting relation and mechanically fastened to one another along their abutting surfaces. The supporting members supporting the holding blades 420 are constructed by placing the pieces having a relatively lower coefficient of expansion along the outer region of the subframe 402 while the pieces forming the transverse supporting members are constructed with the pieces in the inner region of the subframe 402 having a relatively low coefficient of expansion. Consequently, as the tube 10 is heated during manufacturing, the holding blades 420 are brought closer together as the metallic pieces react to the increase in temperature. It is also contemplated that only one pair of supporting members may be constructed of materials with two different temperature coefficients of expansion whereby the holding blades 420 are brought closer together based on the deflection.of such dual-compliance system.

Additionally, it is contemplated that the holding blades 420 may be affixed to their respective supporting members in multiple locations having similar deflection distances during temperature changes so as to bring the holding blades 420 together in a generally parallel fashion, essentially only the X-Y plane of the CRT. Other changes and modifications may be made without departing from the invention in its broader aspects, and, therefore, the aim in the appended claims is to cover all such changes and modifications as fall within the true spirit and scope of the invention.

What is claimed is:

1. A detensioning mask frame assembly for a cathode-ray tube, comprising:

a mask having opposed ends with each end attached to holding blades; and a subframe having a pair of parallel first supporting members and a pair of parallel second supporting members transverse between said first supporting members and forming a continuous frame, each first supporting member having at least one attachment point for attaching said holding blades to said subframe, at least one of said pair of supporting members formed of two portions having different temperature coefficients of expansion.

2. The detensioning mask frame assembly according to claim 1 at which said holding blades are attached to said first supporting members in at least two attachment points.

3. The detensioning mask frame assembly according to claim 1 wherein said portions are formed of metallic materials.

4. A detensioning mask frame assembly for a cathode-ray tube, comprising:

a mask having opposed ends with each end attached to holding blades;

a subframe having an inner and outer region formed by first support members and transverse second support members, said support members formed of two metallic pieces having different temperature coefficients of expansion arranged in side-by-side abutting relation and attached to one another along their abutting surfaces, wherein said first support members have the lower temperature coefficient portion facing the outer region of said subframe and said second support members have the lower temperature coefficient portion facing the inner region of said subframe; and at least one attachment point on each of said first support members for attaching said holding blades to said subframe.

* * * * *